US009153356B2

(12) United States Patent
Chen

(10) Patent No.: US 9,153,356 B2
(45) Date of Patent: Oct. 6, 2015

(54) HIGH DIELECTRIC PERMITTIVITY MATERIALS FROM COMPOSITES OF LOW DIMENSIONAL METALLIC SYSTEMS

(75) Inventor: Sung-Wei Chen, Singapore (SG)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 730 days.

(21) Appl. No.: 12/714,482

(22) Filed: Feb. 27, 2010

(65) Prior Publication Data

US 2011/0212313 A1 Sep. 1, 2011

(51) Int. Cl.

| | |
|---|---|
| ***C25D 5/02*** | (2006.01) |
| ***H01B 3/00*** | (2006.01) |
| ***C25D 11/18*** | (2006.01) |
| ***C25D 11/20*** | (2006.01) |

(52) U.S. Cl.

CPC *H01B 3/004* (2013.01); *C25D 5/02* (2013.01); *C25D 11/18* (2013.01); *C25D 11/20* (2013.01); *Y10T 156/10* (2015.01)

(58) Field of Classification Search

CPC ..... C25D 5/02
USPC ..... 205/131, 150
See application file for complete search history.

(56) References Cited

U.S. PATENT DOCUMENTS

| | | | | |
|---|---|---|---|---|
| 3,720,753 | A * | 3/1973 | Robson | 423/700 |
| 4,448,891 | A * | 5/1984 | Cohen | 502/74 |
| 4,795,833 | A * | 1/1989 | Mitchell | 564/409 |
| 4,912,072 | A * | 3/1990 | Mallouk et al. | 502/74 |
| 6,491,861 | B1 * | 12/2002 | Grosch et al. | 264/628 |
| 7,033,406 | B2 | 4/2006 | Weir et al. | |
| 7,466,536 | B1 | 12/2008 | Weir et al. | |
| 2005/0136608 | A1 | 6/2005 | Mosley | |
| 2006/0108687 | A1 | 5/2006 | Boyanov et al. | |
| 2007/0111503 | A1 * | 5/2007 | Jeon et al. | 438/618 |
| 2009/0192429 | A1 * | 7/2009 | Daniels et al. | 602/43 |
| 2009/0269511 | A1 * | 10/2009 | Zhamu et al. | 427/558 |

FOREIGN PATENT DOCUMENTS

CN 1675137 A 9/2005

OTHER PUBLICATIONS

F. A. Lowenheim, Electroplating, McGraw-Hill Book Company, 1978, pp, 8-24, 119-121.*

L.P. Gor'Kov et al., "Minute Metallic Particles in an Electromagnetic Field", Soviet Physics JETP, Nov. 1965, pp. 940-947, vol. 21, No. 5.

T. Nakano, D. Kiniwa, F.L. Pratt, I. Watanabe, Y. Ikemoto and Y. Nozue, uSR study on ferromagnetism of potassium clusters in aluminosilicate zeolite LTA, Science Direct, Physica B, 2002, p. 550-555.

(Continued)

*Primary Examiner* — Bryan D. Ripa
(74) *Attorney, Agent, or Firm* — Ren-Sheng International

(57) ABSTRACT

Metal nanoparticles are assembled in interrupted metal strands or other structures of characteristic dimensions and orientation to generate a giant dielectric response through a modified GE effect. Careful selection and modification of the host material and synthesis also leads to low dielectric breakdown voltages. In addition, the high dielectric composite material is employed in material configurations that are more scalable for industrial and consumer applications.

15 Claims, 2 Drawing Sheets

(56) References Cited

OTHER PUBLICATIONS

Notification of Transmittal of the International Search Report and the Written Opinion of the International Searching Authority, Jul. 22, 2010.
Saha, "Nanodielectrics with Giant Permittivity," Bulletin of Material Science, vol. 31, No. 3, Jun. 2008, pp. 473-477.
Shen et al., "Impedance Spectroscopy of CaCu3Ti4O12 Films Showing Resistive Switching," Journal of The Electrochemical Society, 156(6), 2009, H466-H470.
Xu et al., Chemistry of Zeolites and Related Porous Materials: Synthesis and Structure, Wiley-Interscience, 2007, pp. 44-46.
Strassler et al., "Comment on Gorkov and Eliashberg's Result for the Polarizability of a Minute Metallic Particle," Physical Review B, vol. 6, No. 7, Oct. 1, 1972, pp. 2575-2577.
Gao et al., "Electrochemical Synthesis of Copper Nanowires," Journal of Physics: Condensed Matter 14, 2002, pp. 355-363.
Cao et al., "The Future of Nanodielectrics in the Electrical Power Industry," IEEE Transactions in Dielectrics and Electrical Insulation, vol. 11, No. 5, Oct. 2004, pp. 797-807.
Rice et al., "Gor'kov-Eliashberg Effect in One-Dimensional Metals?" Physical Review Letters, vol. 29, No. 2, Jul. 10, 1972, pp. 113-116.
Mukherjee et al., "Growth of Silver Nanowires Using Mica Structure as a Template and Ultrahigh Dielectric Permittivity of the Nanocomposite," Journal of Material Research, vol. 17, No. 12, Dec. 2002, pp. 3127-3132.
Roy et al., "High Dielectric Permittivity in Glass-Ceramic Metal Nanocomposites," Journal of Material Research, vol. 8, No. 6, Jun. 1993, pp. 1206-1208.
Lee et al., "Highly Aligned Ultrahigh Density Arrays of Conducting Polymer Nanorods Using Block Copolymer Templates," Nano Letters, vol. 8, No. 8, 2008, pp. 2315-2320.
Kundu et al., "Nanocomposites of Lead-Zirconate-Titanate Glass Ceramics and Metallic Silver," Appl. Phys. Lett. vol. 67, No. 18, Oct. 30, 1995, pp. 2732-2734.
Saha, "Observation of Giant Dielectric Constant in an Assembly of Ultrafine Ag Particles," Physical Review B, 69, 2004, 125416.
Saha et al., "One-Dimensional Organic Giant Dielectrics," Applied Physics Letters, 89, 2006, 043117.

* cited by examiner

HIGH DIELECTRIC PERMITTIVITY MATERIALS FROM COMPOSITES OF LOW DIMENSIONAL METALLIC SYSTEMS

BACKGROUND

Unless otherwise indicated herein, the approaches described in this section are not prior art to the claims in this application and are not admitted to be prior art by inclusion in this section.

In 1965, Gor'kov and Eliashberg originally predicted that minute metallic particles should possess dramatically high polarizability, and thus a high dielectric constant, when small enough (i.e., nano-sized) such that their electronic energy levels are discrete. This effect is hereinafter referred to as the "GE effect." The symmetry of the spherical metallic particles, however, may induce a sufficient depolarization field from electrostatics to wash out the GE effect. This is explained in S. Strassler, et al., "Comment on Gor'kov and Eliashberg's Result for the Polarizability of a Minute Metallic Particle," *Phys. Rev. B,* 6:2575 (1972), the contents of which are incorporated by reference herein.

Further study on the GE effect was carried out in M. J. Rice, et al., "Gor'kov-Eliashberg Effect in One-Dimensional Metals?" *Phys. Review Lett.,* 29:113 (1972) (the "Rice publication"), the contents of which are incorporated by reference herein. In this publication, the researchers recognized that one-dimensional metals, such as mixed-valency planar complex compounds of platinum (Pt), might form interrupted metallic strands under sufficient conditions to manifest the GE effect. More recent research, published in S. K. Saha, "Observation of Giant Dielectric Constant in an Assembly of Ultrafine Ag Particles," *Phys. Rev. B,* 69:125416 (2004) (the "Saha publication"), the contents of which are incorporated by reference herein, has demonstrated the GE effect in interrupted metallic strands synthesized using modern techniques. In this and other studies including T. K. Kundu, et al., "Nanocomposites of Lead-Zirconate-Titanate Glass Ceramics and Metallic Silver," *Appl. Phys. Lett.,* 67:2732 (1995) (the "Kundu publication) and B. Roy, et al., "High Dielectric Permittivity in Glass-Ceramic Metal Nanocomposites," *J. Mater. Res.,* 8:1206 (1993), the contents of which are incorporated by reference herein, researchers have demonstrated giant dielectric responses (on other order of $\in\sim10^{10}$) in small-scale assemblies of ultrafine metal particles (i.e., metal nanoparticles) under external electrical bias, disordered metal/semiconductor particles without bias, and at various temperatures and frequencies.

SUMMARY

In accordance with at least some embodiments of the present disclosure, a method of producing a high dielectric permittivity composite material is disclosed. The method includes selecting alumina as a host material, synthesizing nanoscale copper wires in the host material, applying a current in the range of 100 μA to 10 mA to produce copper atom islands in interrupted strands, and filling pores in the host material that are not filled with the copper wires.

In accordance with at least some other embodiments of the present disclosure, a large scale structure that is at least 1 mm thick is also disclosed. The large scale structure includes multiple layers of composite material having high dielectric constants due to the GE effect.

DETAILED DESCRIPTION

Figure 1:
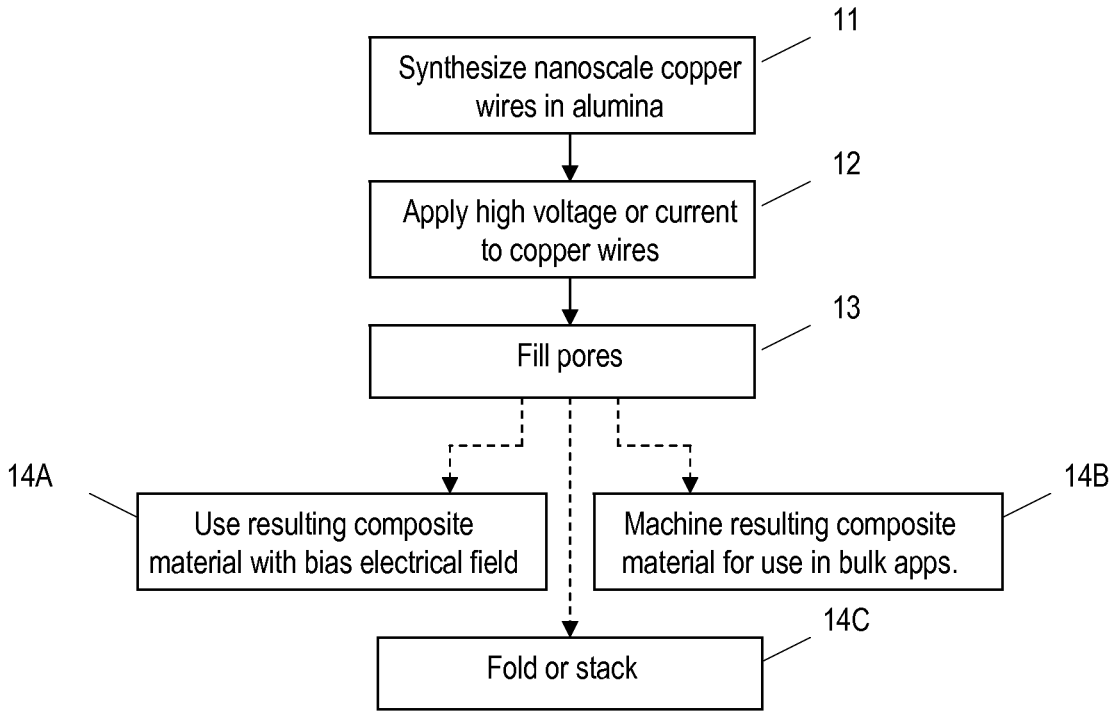
FIG. 1 is a flow diagram of an illustrative embodiment of a process for producing a composite material having a high dielectric constant.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is drawn, inter alia, to the synthesis, production, and use of new dielectric composites of low-dimensional metallic or metal-like particles and molecular templates that guide their synthesis. These particles are assembled in interrupted metal strands or other structures of characteristic dimensions and orientation to generate a giant dielectric response through a modified GE effect. Careful modification of the composite host material also leads to low dielectric breakdown voltages. Materials with high dielectric constants and/or improved voltage breakdown characteristics are useful as they help enable advances in supercapacitor applications and technologies.

One example of a high dielectric permittivity material is a polycarbonate membrane having channels that are filled with ultrafine particles of silver in close physical proximity to each other. This is the material described in the Saha publication. These form interrupted strand configurations similar to a linear strand of beads, with each ultrafine particle of silver as a bead. The silver particles have an effective diameter on the order of nanometers and overall strand lengths of ~50 μm. An overall composite 50 μm thick is estimated to have a dielectric constant of $10^{10}$ along the strand axis. An electrical field bias of 0.05 volts is required to achieve a capacitive state.

Other examples of a high dielectric permittivity material is a nanocomposite of PZT glass ceramics and metallic silver that is described in the Kundu publication, which exhibits a dielectric constant of 300-1000 at 300 K, and silver nanowire assemblies in mica described in P. K. Mukherjee, et al., "Growth of Silver Nanowires Using Mica Structure as a Template and Ultrahigh Dielectric Permittivity of Nanocomposite," *J. Mater. Res.,* 17:3127 (2002), the contents of which are incorporated by reference herein, which exhibits a dielectric constant of around $10^7$. In certain examples where the particles are spherical, an applied electrical field bias is necessary to physically distort the particles and break the spherical symmetry to induce a large dielectric response.

Silver is used in many of the examples because of ease of synthesis and the high yield of pore-filling reaction. However, polypyrrole nanorods as disordered metals may also be used, as shown in S. K. Saha, "One-Dimensional Organic Giant Dielectrics," *App. Phys. Lett.,* 89:043117 (2006), the contents of which are incorporated by reference herein.

As used herein, an interrupted metallic strand is an aggregate of metal particles joined by physical proximity in a lattice, though break junctions, insulating junctions, or other means. These strands may be metal particles in a linear formation interrupted by endogeneous lattice defects as described in the Rice publication. The linear formations between the junctions may be conceived as deep potential wells and modeled as a 1D sequence of "particle-in-a-box" potentials. The model estimates a dielectric constant on the order of the particle lengths, and when integrated over the ensembles of strands, gives the very high values of dielectric constants shown by previous researchers. In some cases, the composite material may be considered as a dual lattice exhibiting a Maxwell-Wagner space charge mechanism, particularly at high frequencies and temperatures.

The present disclosure extends the range of systems that benefit from the GE effect. Extensions of both active metallic materials and host materials contained in such systems are contemplated. This disclosure also introduces novel components for the production of these materials, such as for void-filling, and large structure construction. Even in non-optimal cases, these materials would enhance dielectric constant by orders of magnitude. In addition, material configurations that are more appropriate for large scale applications are described. These material configurations are more scalable for industrial and consumer applications than the single, thin membranes taught in the prior art and minimize the open pores that do not contain nanowires because such open pores become air filled gaps that contribute to electrical breakdown (e.g., by arcing).

The composite materials and the material configurations set forth in this disclosure include one or more of the following features:

1. Particle assemblies of the correct size. Metal or metal-like material particle assemblies are synthesized in host materials near the characteristic length for the particular material so that the GE effect is observed at room temperature or other appropriate operating temperature. The materials may include one or more of Cu, Mg, Au, Zn, Cd, Al, Mg, K, or metal-like materials, such as conducting polymers or conjugated molecular systems.
2. Host materials and chemistries. A porous host material with a pore diameter suitable to template nanoscale assemblies exhibiting quantum energy states (order of 100 nm or less) is selected. The selected host material facilitates chemistry for interrupted strand synthesis of precursors. Host materials may include one of the following classes: porous materials such as alumina, polycarbonate/other organic polymers, zeolites, molecular sieves, other mesoporous materials, or template materials such as mica or glass ceramics. Chemistries may include electro-deposition, pyrolytic, other redox and synthesis reactions. Any voltaic synthesis may use the host as an anode.
3. Application of a post-synthesis step. An optional post-synthesis step is applied to produce the actual interrupted metal strand or final nanostructures. The post-synthesis step may include sintering, current-induced melting (as with silver nanowire conversion to ultrafine particles), or other physio-chemical methods that convert wires or homogeneous structures from the particle assemblies from #1 above into interrupted metal strands.
4. Pore blocking. A supplementary sequence of reactions is carried out to block the remaining pores and prevent these pores from becoming air filled gaps in the final structure. These reactions may include follow-on deposition reactions that go to completion far better than the main reaction. For example, in the case where copper (Cu) wires in alumina are created to exhibit the GE effect, the remaining porous space may be filled with polyester.
5. Post-processing for large structures. Further processing of the composite material is carried out to create an application-relevant structure. This may include folding of filled membranes to create a thick structure, compacting of zeolites filled with nanowires into dense materials, or machining of filled alumina into particles for further use.
6. Use as capacitors. The composite material may be used as high dielectric materials in applications requiring capacitors with or without favorable high voltage characteristics, in some cases, with an applied voltage bias.
7. Use of applied voltage bias. In some embodiments, e.g., in ultrafine assemblies of metals in spherical configurations, a voltage bias is applied to the composite material when it is used in a capacitor structure. The voltage bias may result from an extrinsic field or an intrinsic field. The voltage bias may not be necessary with nanorods or other non-spherical particles.

The characteristic number of metal atoms for a structure to exhibit the GE effect is based on the spatial length of the "particle-in-a-box" potential at the appropriate temperature. Table 1 below shows the characteristic number of metal atoms for various metals at room temperature.

TABLE 1

| Element | Ionic Radius (pm) | Number of Atoms |
|---|---|---|
| Platinum (Pt) | 150 | 267 |
| Copper (Cu) | 77 | 519 |
| Silver (Ag) | 94 | 425 |
| Gold (Au) | 85 | 471 |
| Zinc (Zn) | 74 | 540 |
| Cadmium (Cd) | 95 | 421 |
| Beryllium (Be) | 45 | 889 |
| Magnesium (Mg) | 72 | 556 |
| Aluminum (Al) | 53.5 | 748 |
| Potassium (K) | 138 | 290 |
| Sodium (Na) | 102 | 392 |

The following are some embodiments that include one or more features of the present disclosure.

EXAMPLE 1

Copper in Alumna and Machined Alumina

FIG. 1 is a flow diagram of an illustrative embodiment of a process for producing a composite material having a high dielectric constant. Nanoscale copper wires are first synthesized in alumina as a host via electro-deposition with the alumina as the anode (Block 11). The synthesis is described in further detail in T. Gao, et al., "Electrochemical Synthesis of Copper Nanowires," *J. Phys.: Condens. Matter,* 14:255 (2002), the contents of which are incorporated by reference herein. At Block 12, a high voltage/current is applied to the nanoscale copper wires in alumina. A current between 100 μA to 10 mA is carefully selected to create assemblies of ~500 Cu atom islands in interrupted strands. A low temperature polymerization of polyester then follows to fill those pores that do not go to synthetic completion (i.e., are not filled with the copper nanowires) (Block 13). The resulting composite material may be used with a bias electrical field to generate a large dielectric response along the strand axis (Block 14A). The resulting composite material may also be machined into powder and used in bulk applications (Block 14B). Though the assemblies would become randomly oriented, it is expected that a sufficient number would be oriented in a particular direction of an applied field to account for a strong enhancement of the overall dielectric constant. In addition, the resulting composite material may be folded or stacked to create a large-scale structure (Block 14C).

EXAMPLE 2

Potassium in Zeolites

Figure 2:
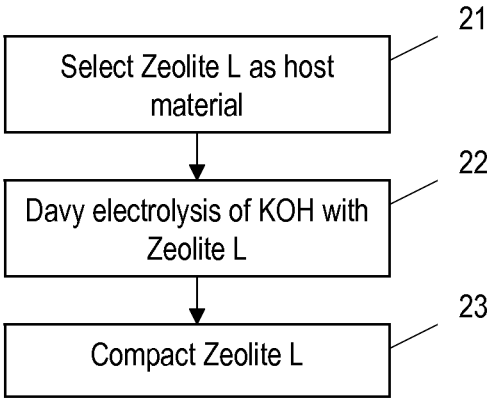
FIG. 2 is a flow diagram of an illustrative embodiment of a process for producing a composite material having a high dielectric constant.

FIG. 2 is a flow diagram of an illustrative embodiment of a process for producing a composite material having a high dielectric constant. Nanoscale metals may be synthesized in structures such as zeolites, e.g., 1D channel zeolites and some 2D and 3D channel zeolites that have non-interconnected channels. 1D channel zeolites may include Zeolite L, Zeolite-Linde-Type-L (LTL), AlPO-31 (ATO) zeolite, roggianite (-RON) zeolite, EU-1 (EUO) zeolite, RUB-3 (RTE) zeolite, and other 1D channel zeolites disclosed in Xu, R., et al., *Chemistry of Zeolites and Related Porous Materials: Synthesis and Structure*, Wiley-Interscience, pp. 44-46 (2007).

At Block 21, Zeolite L is selected as the host material. Then, at Block 22, conventional Davy electrolysis of KOH is carried out with Zeolite L to produce potassium nanowires in Zeolite L. At block 23, Zeolite L that is filled with potassium nanowires is compacted into dense materials for use in an application-relevant structure. By choosing a zeolite with appropriate channel length, such as Zeolite L (which can be grown to crystal lengths of 20 to 7000 nm), potassium nanowires may be grown in each channel exactly matching the optical distance (~80 nm) to manifest the GE effect. Zeolites as a host have the advantage of creating an ensemble of single length nanowire segments matched precisely to the "particle-in-a-box" length, instead of relying on kinetically or thermodynamically controlled reactions in extended mesoporous channels. Though Zeolite L has strictly linear channels, each particle will be oriented randomly in space (zeolites with nonlinear channels will be oriented equivalently in the aggregate), leaving only a fraction oriented parallel to any applied field. By simple geometric integration of the dielectric vector, the enhancement of dielectric constant is still expected to be high order, only, at most, a few orders of magnitude lower than the $\in \sim 10^{10}$ of an oriented system. Additionally, because each wire represents a single "particle-in-a-box" potential, applications need no applied bias field.

EXAMPLE 3

Figure 3A:
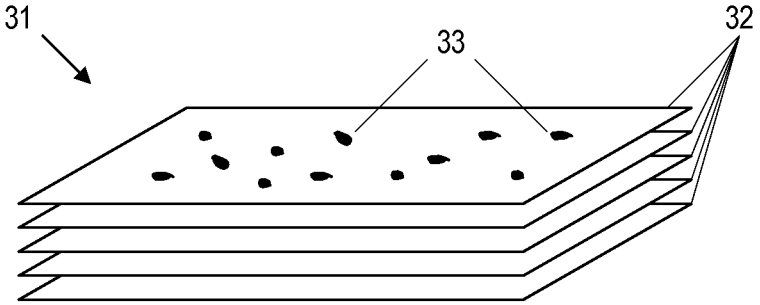
FIGS. 3A and 3B illustrate two examples of a large scale structure that contains high dielectric permittivity materials.
Figure 3B:
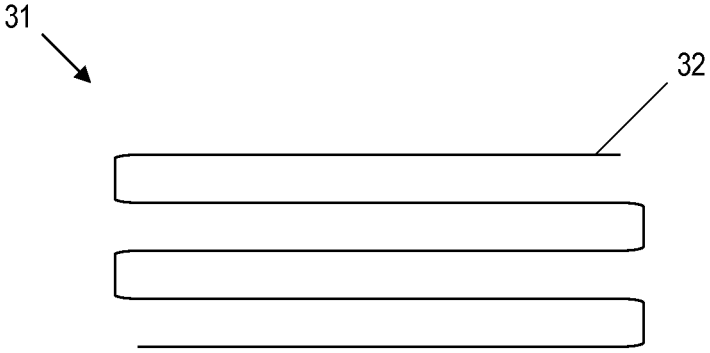

Though silver ultrafine particles have been created in thin (50 μm) polycarbonate membranes to create high dielectric compounds, overall scale up from these structures has not been contemplated. However, polycarbonate or other flexible membranes could form the basis of a roll-to-roll manufacturing process, with sheets that are folded together, cut and stacked, or rolled to create thick structures. A 10 cm thick structure includes approximately 2000 sheets of membrane that are stacked or folded. Rolled structures easily scale to consumer power cells (similar to consumer battery cells that are constructed from rolled electrodes). FIGS. 3A and 3B illustrate two examples of a large scale structure that contains high dielectric permittivity materials. In these examples, large scale structure 31 includes multiple stacked sheets of polycarbonate membrane 32 containing silver nanoparticles 33 (FIG. 3A) or multiple folded sheet of polycarbonate membrane 32 containing silver nanoparticles 33 (FIG. 3B). In other embodiments, large scale structure 31 may include multiple folded or stacked sheets of other materials having high dielectric constants due to the GE effect.

EXAMPLE 4

According to the Rice publication, nanorods of polypyrrole have been synthesized using low temperature pyrolysis in alumina and shown to exhibit giant dielectric effects. The mechanism is posited to be disordered metal phases interrupted by semiconductor phases to create interrupted strand structures. Other work, published in J. I. Lee, et al., "Highly Aligned Ultrahigh Density Arrays of Conducting Polymer Nanorods Using Block Copolymer Templates," *Nano Lett.*, 8:2315 (2008) (the "Lee publication"), the contents of which are incorporated by reference herein, teaches electrodepositing of polypyrrole on indium tin oxide (ITO) to create ultrahigh density vertical arrays of highly conductive rods (though they have not been tested for capacitive function). According to one or more embodiments of this disclosure, many other conducting polymers, ranging from polyaniline to more exotic specialty polymers may be synthesized in host materials, replacing metals used in the Rice and Lee publications. In addition, control of dopant levels through known chemical techniques, such as kinetic control, allows good control of interrupted strand dimensions and defect density. The low weight of these polymers make them ideal for creating systems with a low weight-to-performance ratio.

Capacitor system with high effective permittivity enables multibillion dollar energy markets ranging from portable electronics to automotive to large power systems. The materials set forth in the present disclosure would enable applications across these markets, particularly those requiring very high dielectric constants.

Industrial and academic efforts have produced high dielectric materials, but each with considerable associated difficulties. Many ceramic high dielectric materials for parallel plate capacitors suffer from low breakdown levels because of material structural defects. Other materials with better processing characteristics have insufficient dielectric properties for large scale use (e.g., dielectric constants in the tens, not hundreds). Though researchers have contemplated nanodielectrics for industrial applications as published in C. Yang, et al., "The Future of Nanodielectrics in the Electrical Power Industry," *IEEE Trans. Dielec. and Elec. Insul.*, 11:797 (2004), the contents of which are incorporated by reference herein, little work has been performed to target structures and systems that are appropriate for non-laboratory applications.

One exception may be the company, EEStor. EEStor is the assignee of U.S. Pat. Nos. 7,033,406 and 7,466,536, which are directed to low void and low defect $BaTiO_3$ structures. $BaTiO_3$ possesses abnormally large dielectric constants but voids and defects from traditional syntheses lead to poor electric breakdown robustness. EEStor claims to have solved this problem with low-temperature and kinetically labile synthetic routes. However, considerable skepticism remains about the commercial viability and scalability of their product. In addition, even in the EEStor materials, dielectric constants of $\in > 10^4$ are unlikely in production.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I claim:

1. A method of producing a high dielectric permittivity composite material comprising:

selecting a porous host material defining a first set of pores and a second set of pores, wherein a pore diameter of any pore of the first set of pores is not greater than 100 nm;

electrolyzing an ionic compound to produce metal nanostructures in the first set of pores;

sintering, after electrolyzing, the metal nanostructures to produce interrupted metal strands; and then filling the second set of pores.

2. The method of claim 1, wherein the porous host material is a zeolite.

3. The method of claim 2, wherein the porous host material has channel lengths of 20 to 7000 nm.

4. The method of claim 3, wherein the porous host material containing the interrupted metal strands has a dielectric constant that is at least $10^8$.

5. The method of claim 1, wherein the porous host material is Zeolite L and the metal nanostructures comprise potassium.

6. The method of claim 5, wherein the metal nanostructures are synthesized in the Zeolite L by Davy electrolysis of KOH.

7. The method of claim 6, wherein the metal nanostructures are formed to have an optical distance of about 80 nm, which is configured to manifest the Gor'kov-Eliashberg effect.

8. The method of claim 1, further comprising compacting the porous host material containing the metal nanostructures.

9. A method of producing a high dielectric permittivity composite material, comprising:

selecting a host material with pores, wherein the pores comprise nano- or micro-scale pores;

synthesizing conductive material in the pores to form interrupted strands of the conductive material in the pores, wherein the conductive material is a metal; and filling the pores in the host material that are not filled with the conductive material, wherein synthesizing the conductive material in the pores to form the interrupted strands comprises:

electrolyzing an ionic compound to produce nanostructures in the pores, wherein the nanostructures comprise the metal; and current-induced melting, after electrolyzing, the nanostructures to produce the interrupted strands.

10. The method of claim 9, wherein the host material is alumina, the conductive material is copper, the pores are filled with polyester, and a current in the range of 100 μA to 10 mA is applied to produce copper atom islands in the interrupted strands.

11. The method of claim 10, wherein the filling comprises a low temperature polymerization of polyester.

12. The method of claim 10, further comprising: applying a bias electrical field in a manner to generate a large dielectric response along an axis of one of the interrupted strands.

13. The method of claim 10, further comprising:

machining the host material.

14. The method of claim 10, further comprising:

stacking multiple sheets of the host material.

15. A method of producing a high dielectric permittivity composite material comprising:

selecting a porous host material defining a first set of pores and a second set of pores, wherein a pore diameter of any pore of the first set of pores is not greater than 100 nm;

electrolyzing an ionic compound to produce metal nanostructures in the first set of pores;

current-induced melting, after electrolyzing, the metal nanostructures to produce interrupted metal strands; and then filling the second set of pores.

* * * * *